United States Patent [19]

Burns

[11] Patent Number: 4,533,131

[45] Date of Patent: Aug. 6, 1985

[54] PORTABLE DECOLLATING MACHINE

[76] Inventor: James E. Burns, 4221 NE 25th Ave., Lighthouse Point, Fla. 33308

[21] Appl. No.: 319,747

[22] Filed: Nov. 9, 1981

Related U.S. Application Data

[63] Continuation of Ser. No. 88,596, Dec. 26, 1979, abandoned.

[51] Int. Cl.[3] ..... B65H 41/00

[52] U.S. Cl. ..... 270/52.5; 493/410

[58] Field of Search ..... 270/52.5; 493/410; 242/56.4, 5, 179

[56] References Cited

U.S. PATENT DOCUMENTS

| | | | |
|---|---|---|---|
| 2,440,302 | 4/1948 | Sherman | 270/52.5 X |
| 3,143,342 | 8/1964 | Pine | 270/52.5 |
| 3,386,729 | 6/1968 | Pine | 270/52.5 |
| 3,857,557 | 12/1974 | Gill | 270/52.5 |
| 4,133,520 | 1/1979 | Roy | 270/52.5 |

*Primary Examiner*—A. J. Heinz

*Attorney, Agent, or Firm*—Malin, Haley, McHale & Barron

[57] ABSTRACT

A portable, manually or motor operated machine for separating continuous multiple ply business forms into individual stacks, each having a single ply while simultaneously removing the carbon paper for disposal. The device includes a housing, a pair of separating rollers, a carbon paper winding reel that is manually or motor driven, and carbon sheet guide bars positioned strategically relative to the rollers which allow for efficient, rapid separation of the continuous business form. An attachable accessory allows separation of carbonless multiple ply business forms into two stacks of single plies. The drive shaft of the carbonless separator accessory replaces the carbon paper winding reel, and includes one or two pairs of belt driven wheels that rest on the separating rollers. The machine may be independently mounted on a table top, or be used in conjunction with a mateable floor stand.

5 Claims, 16 Drawing Figures

Fig. 1.
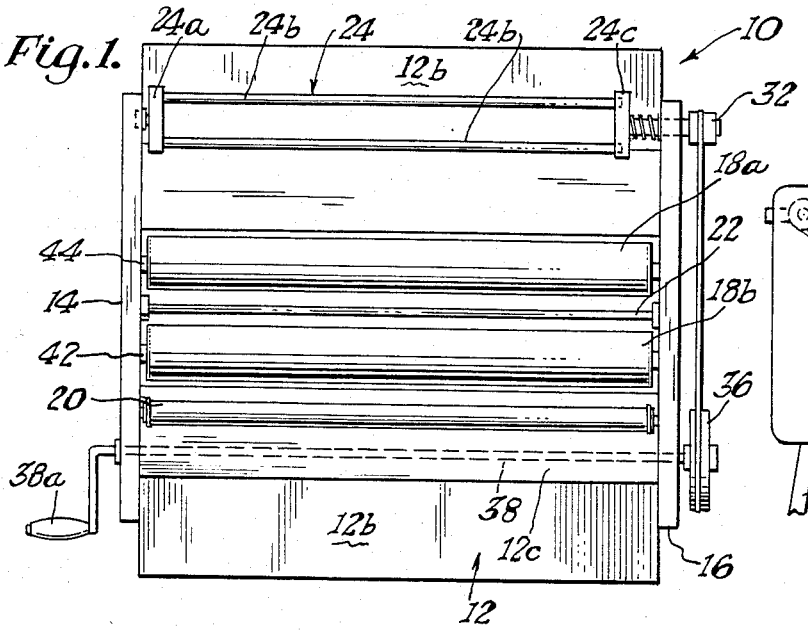
Fig. 4.
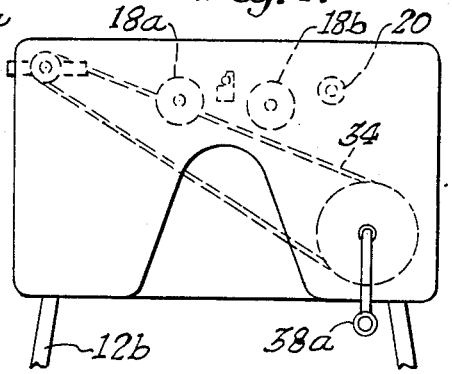
Fig. 2.
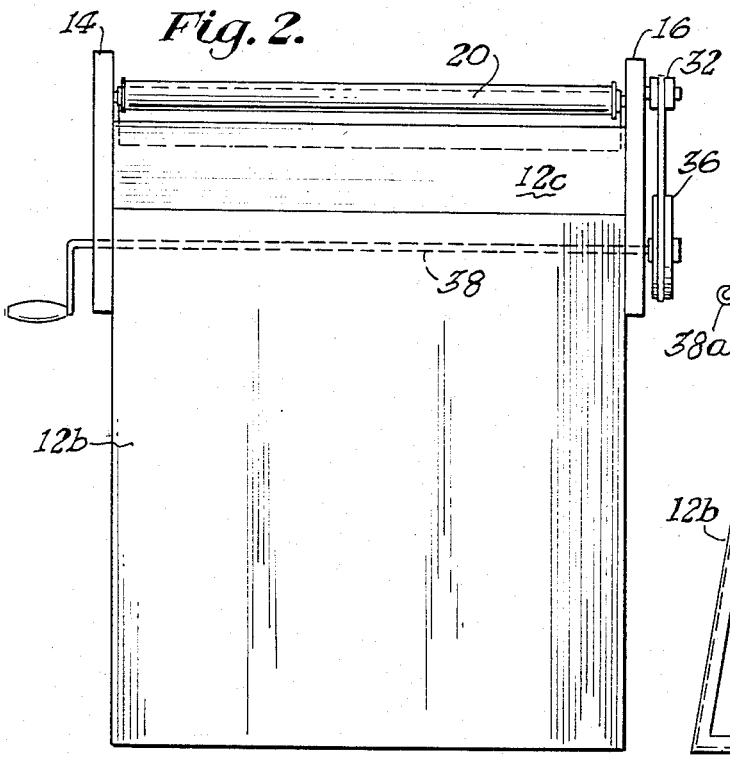
Fig. 3.
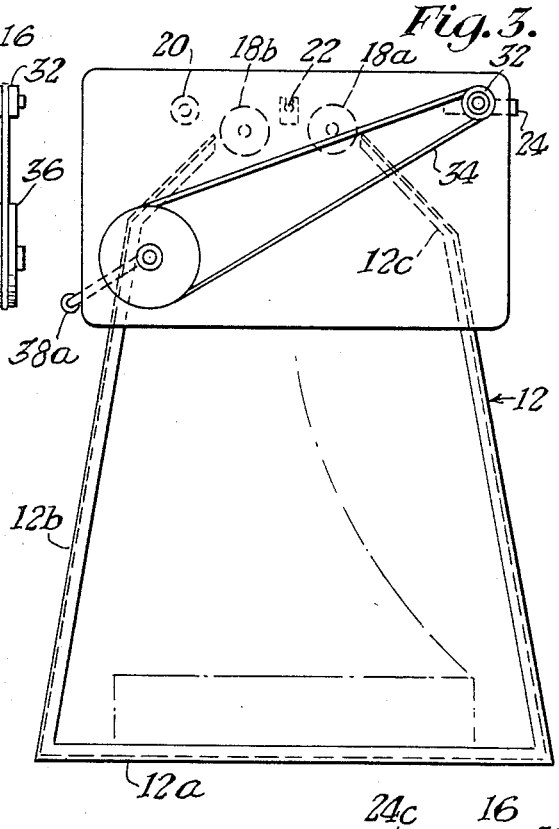
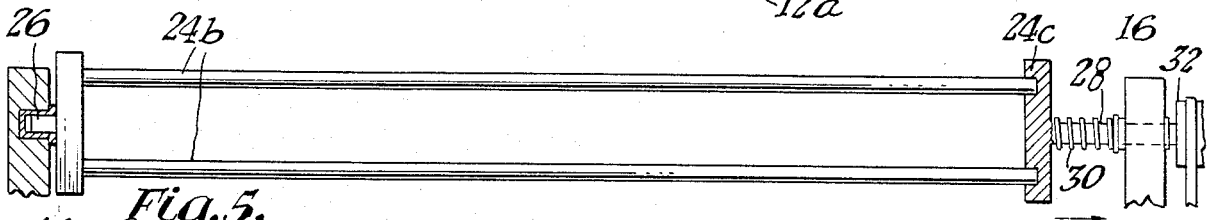
Fig. 5.
Fig. 6.
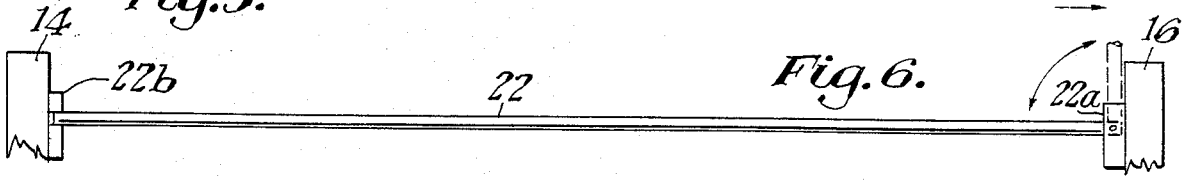

Fig. 15.
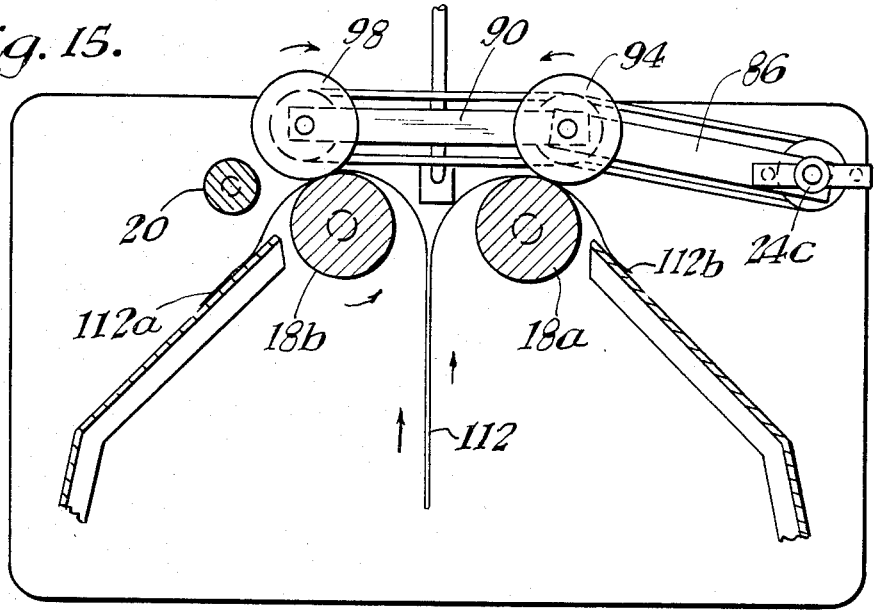
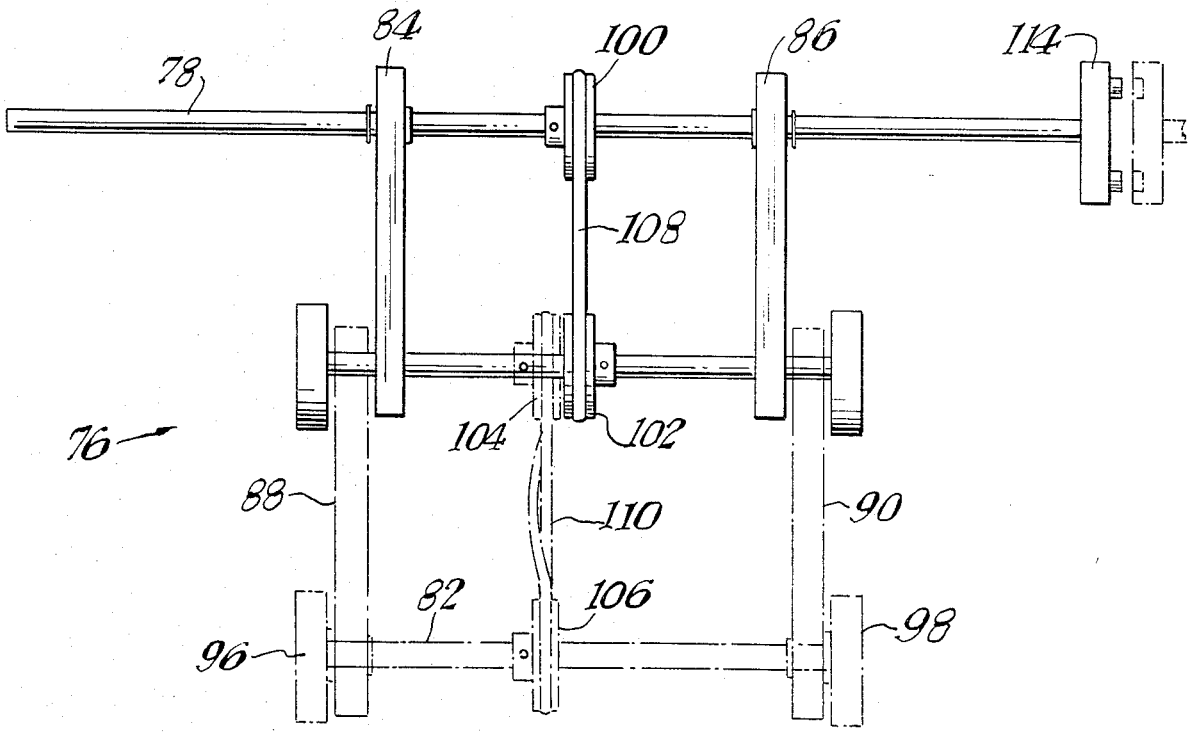
Fig. 16.

PORTABLE DECOLLATING MACHINE

This is a continuation of application Ser. No. 088,596, filed Dec. 26, 1979, and now abandoned.

BACKGROUND OF THE INVENTION

This invention relates to a portable, motorized, or manually operated decollating or deleaving machine which allows for a carbon or carbonless multiple layered continuous business form to be separated into separate stacks, with simultaneous removal of a carbon ply (if present) initially disposed therebetween.

With the present usage of continuous business forms, such as computer printouts and the like, which provides an original and layered multiple duplicate forms, it becomes necessary to separate the original, the carbon sheet and the copy or copies. Manual separation is cumbersome, time consuming, and oftentimes soils the hands of the operator because of contact with the carbon paper. For extremely large scale operations, elaborate complex machines have been devised for automatically separating numerous layers of continuous forms. However, such machines are completely unsuitable for utilization in a small office due to cost and size limitations. The present invention is operated by a small electric motor or by hand, occupies little storage space, is portable, and eliminates manual separation of a carbon paper during the decollating operation.

The device includes an attachable unit that provides efficient separation of carbonless multiple ply business forms.

BRIEF DESCRIPTION OF THE INVENTION

A machine for decollating a multiple layered continuous business form while simultaneously removing the carbon sheet therefrom, comprising a supporting housing, a pair of paper separating rollers disposed laterally across an upper opening in said housing, a first carbon paper guide bar parallel to and disposed adjacent one of said rollers, and a second carbon paper guide bar disposed in a plane vertically separating the first and second paper rollers, a carbon winding reel disposed parallel to said rollers, and a driving means for said carbon paper winding reel, such as a hand crank or motor.

The housing may have a pair of protruding exterior trays on each side for collecting the separated individual plies into individual stacks or the stacks may form on the supporting surface (table top or the like). The housing includes an inner hollow chamber for stacking the business form prior to its separation, the chamber terminating vertically in an upper opening defined by the pair of separating rollers.

A separate floor stand may be employed upon which the machine is mounted that includes exterior stacking trays. The loading of the machine and the resultant path of the multiple ply form during separation is as follows. The multi-ply form to be separated is initially stacked in the interior chamber of the housing. One end is manually fed vertically up through the opening defined by the pair of separating rollers. At this point, one of the plies is forced in one direction, around the upper surface of one roller while the other ply (with carbon paper attached) is forced in an opposite direction and positioned around the top of the opposite roller such that both plies are traveling in opposite, horizontal directions. The ply (which has the carbon still affixed) is then positioned vertically in a downward direction toward its receiving tray, traversing past the first carbon guide bar. The carbon paper is separated from the ply around the first carbon guide bar (approximately 180 degree turn around) and directed back toward the rollers, passing beneath a second carbon guide bar which is disposed substantially in a plane (vertically) between the first and second rollers. The carbon continues on to a winding reel which is connected by a pulley and belt to a rotatable drive unit (hand crank or motor) mounted on the side of the housing.

It is the force on the carbon sheet which drives all of the plies and carbon during the separation. As tension force is applied on the carbon ply (by rotation of the winding reel), the multi ply form moves around the rollers, and after separation each ply is collected on each side of the housing.

The second carbon guide bar is strategically located to position the moving carbon paper to effect some slight pressure on the ply on the first roller without disturbing the ply and carbon on the second roller.

The carbon winding reel that collects the carbon to be discarded has a removable end which allows the reel shafts to be removed from the housing. The carbon is free to slide off the reel shafts into a wastebasket or the like.

The device, including the housing, is quite lightweight, sized to be easily moved about an office and takes up very little storage space.

The device described above is also suitable using an accessory for separating carbonless multiple ply business forms into two separate single ply stacks. The attachable accessory includes a drive shaft having a pulley mounted thereon which is mounted by movable supporting arms parallelly disposed to a roller drive shaft having a pair of wheels connected thereto at each end. The roller drive shaft includes a pulley that is linked to the main drive shaft by suitable belts. The carbonless drive shaft is inserted in the machine, replacing the carbon winding reel which is affixed to the system driving means. The wheels which rest on at least one roller under the weight of gravity in effect provide the upward driving force on one ply of the business form being separated which is disposed over one roller, while the other ply is directed over the opposite roller and falls by gravity into an appropriate stack.

In this embodiment of the attachable accessory, the unseparated carbonless form is directed vertically up through the system rollers and over the top of the roller closest to the first carbon guide bar. At this point, the plies are separated such that the upper ply is disposed around the bottom and back side of the first carbon guide bar and directed back across the top of the guide rollers and disposed between one of the rollers and the wheels of the attachable accessory. The other ply (the lower ply) is directed downwardly to its separated stacked position. Rotation of the system drive, either manually or by electric motor, causes the wheels resting on the roller and the upper ply disposed therebetween to pull the upper ply around the first carbon guide bar (even though this ply is not a carbon) pulling upward on the unseparated plies. This provides sufficient force to separate the two plies into two separate single ply stacks.

And yet another alternate embodiment of the attachable accessory, two pairs of wheels are utilized, each of which are mounted on shafts having pulleys directly connected to the accessory drive shaft. Thus, the accessory drive shaft has one pulley, the first pair of wheels shaft has two pulleys, and the second pair of wheels shaft has a single pulley. Belts are disposed between the pulleys. The pulley belt between the first and second pair of wheels is doubled over to provide direction on the second pair of wheels opposite to that of the first pair of wheels. In this embodiment, the two ply sheet is disposed up between the system guide rollers with each sheet being separated and disposed over a separate roller. When the accessory drive shaft is rotated by manual or motor power to the system, both sets of wheels rotate in opposite directions, forcing the ply disposed between the wheels and the guide rollers to separate into single ply stacks on each side of the machine.

It is an object of this invention to provide a portable, manually or motor powered decollating machine for separating a multiple layered continuous business form into separate stacks of a single ply and for simultaneously removing the carbon sheet disposed therebetween.

And yet another object of this invention is to provide a manually-powered device for separating multiple ply, continuous business forms which reduces clogging or jamming along the paper path during separation, and which provides for separation and disposal of a carbon sheet without requiring operator contact with the carbon.

And yet another object of this invention is to separate carbonless, multiple ply business forms into single ply stacks.

In accordance with these and other objects which will be apparent hereinafter, the instant invention will now be described with particular reference to the accompanying drawings.

BRIEF DESCRIPTION OF THE DRAWINGS

FIG. 1 shows a top plan view of the present invention.

FIG. 2 shows a front elevational view of the present invention.

FIG. 3 shows a side elevational view of the present invention.

FIG. 4 shows a side elevational view of the present invention from the side opposite that shown in FIG. 3.

FIG. 5 shows the carbon winding reel utilized with the present invention.

FIG. 6 shows a side elevational view of the carbon tension bar utilized in the present invention.

FIG. 15 shows a schematic view of the paper path used with the embodiment of FIG. 13.

FIG. 16 shows a top plan view of the attachment used in the embodiment shown in FIG. 13.

PREFERRED EMBODIMENT OF THE INVENTION

Figure 7:
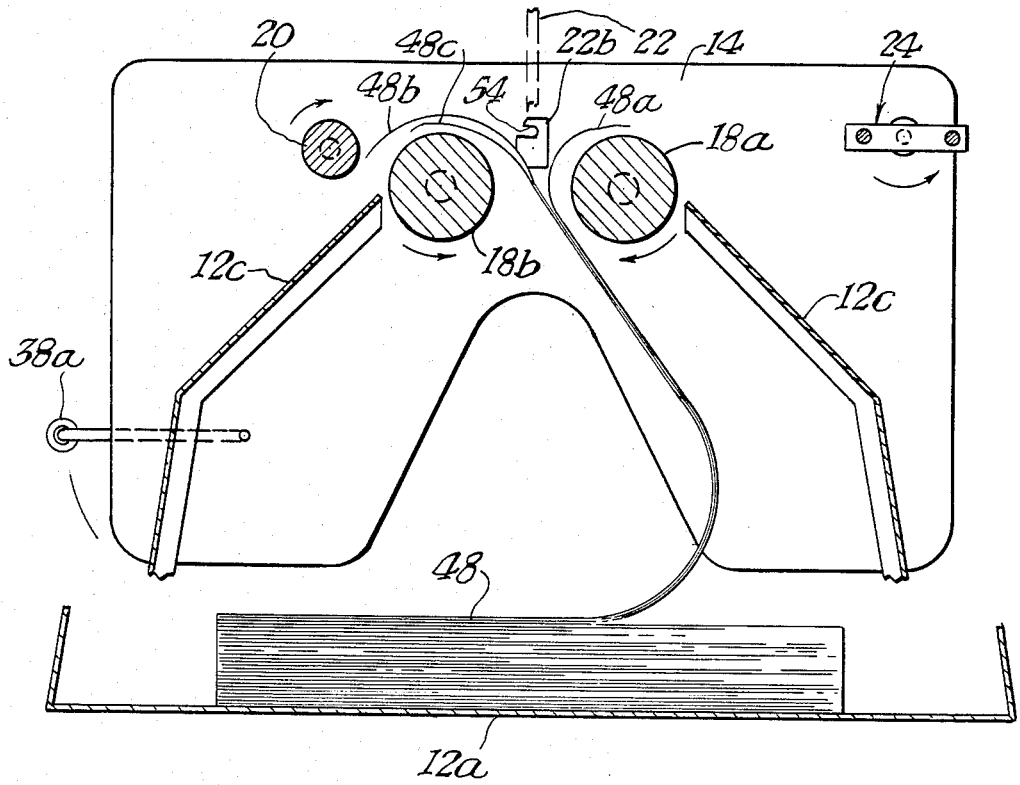
FIGS. 7, 8, and 9 show a schematic diagram of the paper feed utilized with the embodiment shown in FIGS. 1 through 6.
Figure 8:
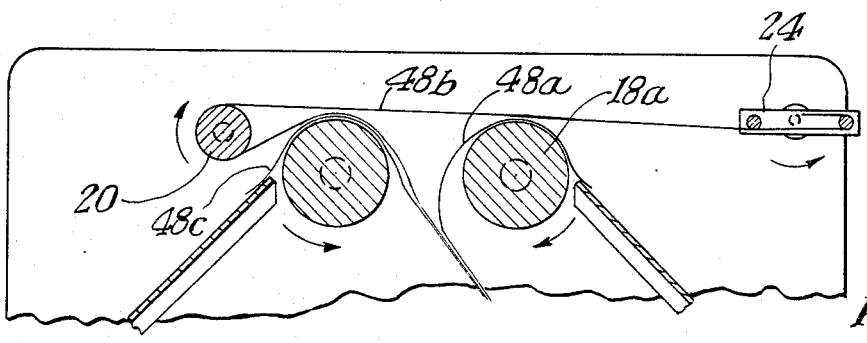
Figure 9:
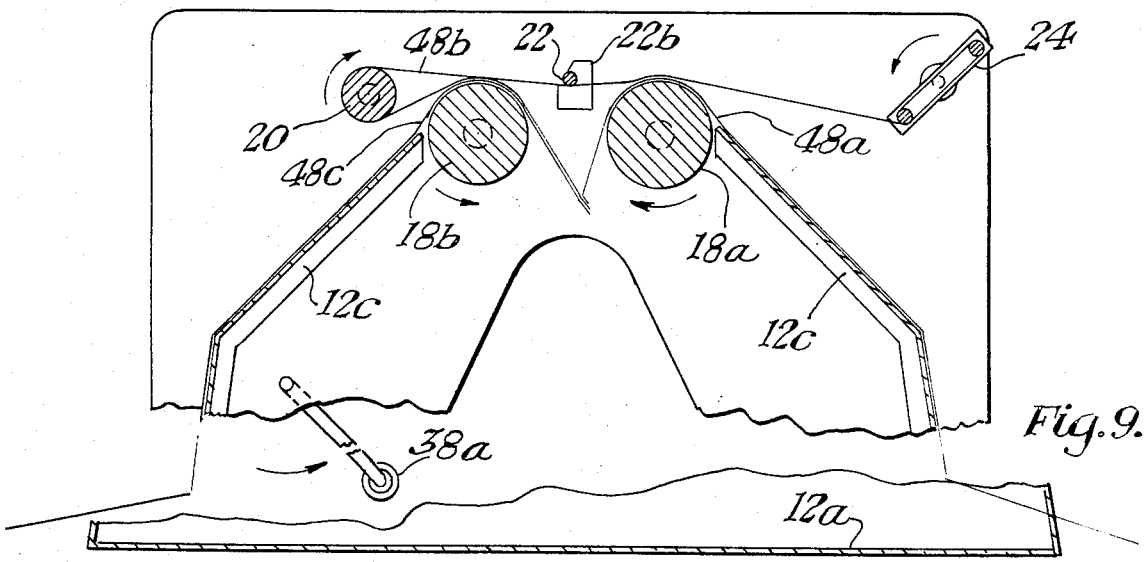

In brief the disclosed desk top deleaver is shown in FIGS. 7, 8, and 9 for decollating an assembly of continuous forms 48 including a plurality of continuous sheets **48*c*, 48*a* and 48*b* into separate stacks below 12*c* on the left and below 12*c* on the right. The deleaver includes a housing 14, and two sheet means 18*b* and 18*a* for decollating an assembly of continuous forms. The two sheet means includes a first sheet means 18*b* for supporting and changing the direction of travel of a first sheet 48*c* toward one of the stacks (the left stack in FIG. 9) and a second sheet means 18*a* for supporting and changing the direction of travel of a second sheet 48*a* toward another one of the separate stacks (the right stack in FIG. 9). The two sheet means 18*b* and 18*a* are connected to the housing. Both the first sheet means 18*b* and the second sheet means 18*a* have center lines positioned generally parallel to a transverse line across the sheets. The centerlines of the two sheet means 18*b* and 18*a* are positioned in spaced apart relationship shown in FIGS. 7, 8 and 9 forming a working space between the two sheet means 18*b* and 18*a* through which the continuous forms move as shown in FIG. 8 in a direction from a lower entrance side of the working space between the two sheet means 18*b* and 18*a* toward the upper exit side of the working space between said two sheet means 18*b* and 18*a*. The working space is illustrated as a space or column lying in a generally horizontal plane between said two sheet means 18*b* and 18*a*. The deleaver also includes a take-up means 24, a third sheet means 20 shown in FIG. 7 and a fourth sheet means 22 shown in FIG. 8**.

The third sheet means 20 is used to change the direction of travel of a third sheet **48*b* toward said take-up means 24 shown in FIGS. 7 and 8. The third sheet means has a center line generally parallel to the center lines of the two sheet means 18*b* and 18*a* and is connected to the housing. The third sheet means is positioned adjacent the first sheet means 18*b* and near the generally horizontal plane of the working space between the two sheet means 18*b* and 18*a*, therefore the working space is also generally positioned between the third sheet means 20 and the second sheet means 18*a*. The take-up means 24 shown in FIG. 7 is connected to the housing and positioned adjacent to the second sheet means 18*a* and near the generally horizontal plane between the two sheet means 18*b* and 18*a*. The take-up means 24 is positioned to place the working space and second sheet means 18*a* generally between the take-up sheet means 24 and the first sheet means 18*b*. The take-up means 24 therefore pulls the third sheet 48*b* through the working space a first and second time, as shown in FIG. 9 with the aid of the fourth sheet means 22. The third sheet means 20, the fourth sheet means and the take-up means 24 are constructed and arranged to position the third sheet 48*b* in frictional engagement with the second sheet 48*a* of the continuous forms and the second sheet means 18*a*** after decollating to aid in properly separating the assembly of continuous forms moving through the working space.

The fourth sheet means 22 has a center line generally parallel to the center lines of the two sheet means **18*b* and 18*a* and is connected to the housing. The fourth sheet means is positioned and arranged to engage the third sheet 48*b* within the working space between the third sheet means 20 and the second sheet means 18*a*, thereby directing the third sheet 48***b* through the working space for the second time. The third sheet 48*b* is positioned to aid in proper decollating of the assembly of continuous forms as it moves through the working space. As the first sheet and third sheet move toward the first sheet means 18*b* in the working space and the second sheet moves toward the second sheet means 18*a* in the working space, the position of the fourth sheet means 22 and the third sheet 48*b* aid in preventing the second sheet 48*a* from crossing over to the first sheet means 18*b*.

In detail, referring now to FIGS. 1 through 9, a manually operated embodiment of the present invention is shown generally at 10 comprised of a thin, rigid housing 12 having a horizontal base portion 12*a* which forms the bottom of the device and the base of a chamber for receiving the continuous multiply form to be decollated. The housing 12 includes vertical side walls 12*b* having upper angled portions 12*c* which serve as guide surfaces for individual plies as described below. Vertical, parallel, side panels 14 and 16 are mounted on each side of the housing 12. A pair of guide rollers 18*a* and 18*b* and shafts 42 and 44 respectively, are connected at each shaft end on each side to panels 14 and 16. The rollers freely rotate in the direction indicated by the arrows. Positioned strategically in the space between the rollers, which define the upper opening of the housing, is the second carbon paper guide bar 22. The carbon paper winding reel 24 is shown also mounted between panels 14 and 16 on a first shaft 26 at one end and a second shaft 28 which has a pulley 32 connected on the end outside panel 16. A spring 30 is mounted between end 24*c* of the reel and panel 16. The first carbon guide roller 20 is disposed horizontally away from roller 18*b* and the intermediate separation between rollers 18*a* and 18*b*. A handle 40 is connected to shaft 38 which has a pulley 36 connected at its opposite end with a belt 34 connecting pulleys 32 and 36. The shaft 38 is free to rotate and is mounted between panels 14 and 16.

FIGS. 7 through 9 show the paper path beginning with a stacked continuous multi-ply form 48 which is disposed on housing panel 12*a* in the bottom of the intermediate chamber in the housing. The form moves vertically upward, fed between rollers 18*a* and 18*b* such that one ply constituting either the original or a copy is received over the top of roller 18*a* and proceeds down on the outside of the housing 12*b* where it forms a single ply stack, the ply being indicated as 48*a*. The remaining plies which include a carbon 48*b* and single ply form 48*c*, are disposed over the top of roller 18*b*. Separation of the carbon 48*b* is achieved through the first carbon guide bar 20 around which the carbon paper does approximately a 180 degree turn. It is then threaded back beneath a second carbon paper guide bar 22 disposed in the opening between rollers 18*a* and 18*b*. The carbon is connected to the carbon winding reel 24. The single ply form 48*c* traverses vertically downwardly to surface 46 which represents a table or the top of a storage cabinet upon which the entire device is mounted. Whenever the hand-crank 38*a* is rotated, putting tension on the carbon 48*b*, the multiple ply form is pulled vertically upward, providing sufficient force to achieve separation of the plies while pulling the carbon around the first guide bar 20 and beneath the second guide bar 22. The operation is continuous such that once the plies to be separated into individual stacks are past around the upper most points of rollers 18*a* and 18*b*, they are pulled by gravity into the storage position on each side in separated stacked arrays.

It should be noted that a vertical line through the center of roller 18*b* FIG. 7 divides said roller 18*b* into a left side and right side. The left side is a side opposite from roller 18*a*. A vertical line through the center of roller 18*a*, FIG. 7, divides that roller into a right and left side. The right side of roller 18*a* in FIG. 7 is the side opposite roller 18*b*.

Once the operation is complete, the carbon which is wrapped around the carbon reel 24 may be disposed by first removing the carbon reel from the machine. This is achieved by pressing reel end 24 toward spring 30 which allows for shafts 24*b* to be separated from end 24*c*. This frees reel mount 26 from panel 14. The winding reel 24 is such that shafts 24*b* can be separated from the reel end 24*c* with the carbon still upon it. Once the shafts 24*b* are removed, then the reel and carbon will slide off into the basket. The shaft and reel end are then remounted back into the machine.

FIGS. 7 through 9 show the vertical and horizontal relationships between the rollers 18*a* and 18*b* and carbon guide bars 22 and 20. Carbon guide bar 22 is disposed between the rollers and the lower edge of the carbon guide bar 22 is disposed below the top edges defined by a horizontal plane between the guide rollers. This provides additional pressure on the ply on roller 18*a* to aid in the separation and to prevent jamming. The first carbon guide bar 20, which is laterally disposed away from roller 18*b*, is positioned such that its lower most edge is below the upper edge of roller 18*b*, while the upper edge has a free path to the lower edge of bar 22. The carbon after it passes under, around and over roller 20, moves back to guide bar 22 without contacting the ply and carbon moving over roller 18*b*, unless they are out of position by jamming or buckling.

FIG. 6 shows the second guide bar 22 that pivots at one end from block 22*a* upwardly out of the way for initially threading the machine. Normally it is held in a groove 54 in block 22*b*. As shown in FIG. 2, the supporting surface 46 also acts as the collecting tray on each side for the forms. A floor stand (not shown) may be employed, including trays protruding out on each side of the housing for receiving the stacked individual piles of the single ply.

Figure 10:
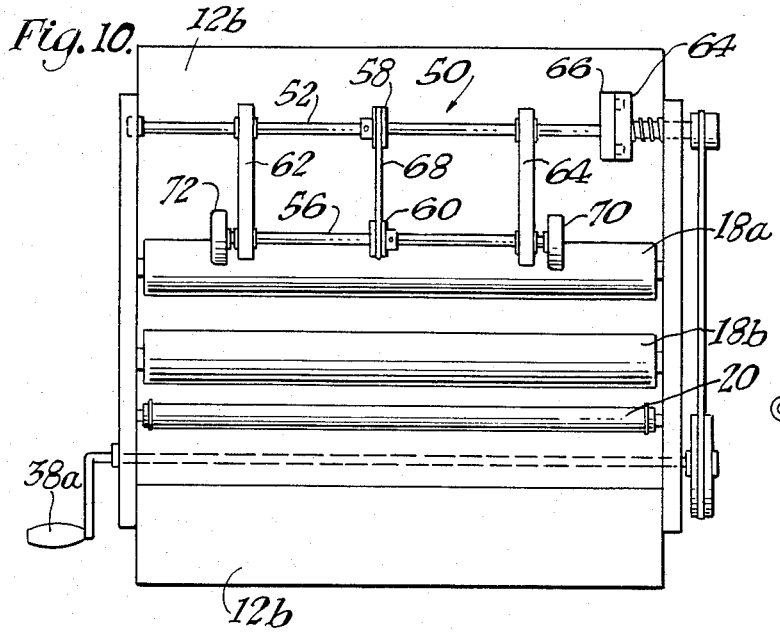
FIG. 10 shows a top plan view of the present invention with a carbonless separating attachment connected thereto.
Figure 11:
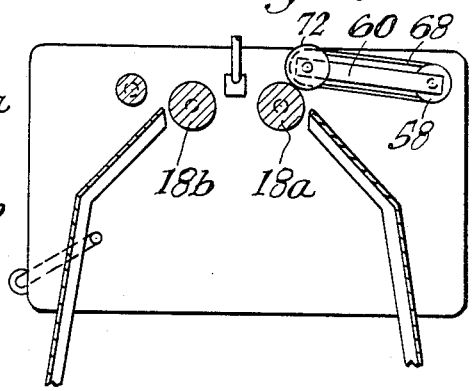
FIG. 11 shows a schematic side elevational view of the alternate embodiment of FIG. 10.
Figure 13:
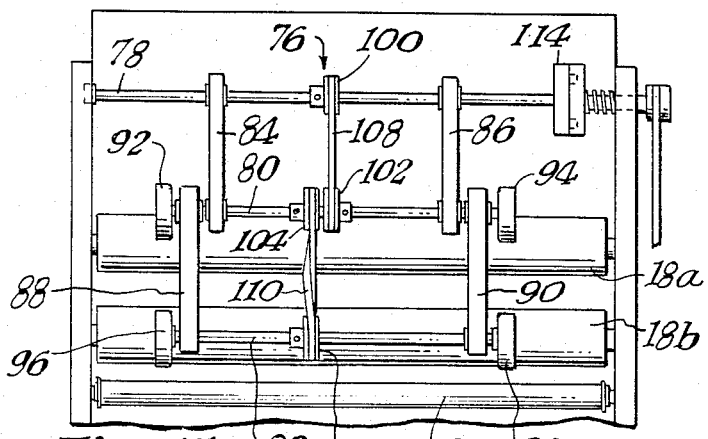
FIG. 13 shows yet another alternate embodiment of the carbonless separator attachment.
Figure 14:
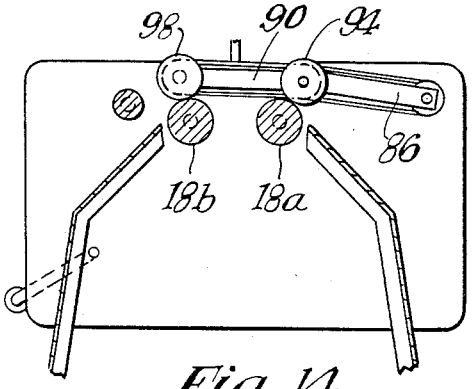
FIG. 14 shows a side elevational view of the alternate embodiment of FIG. 13.
Figure 12:
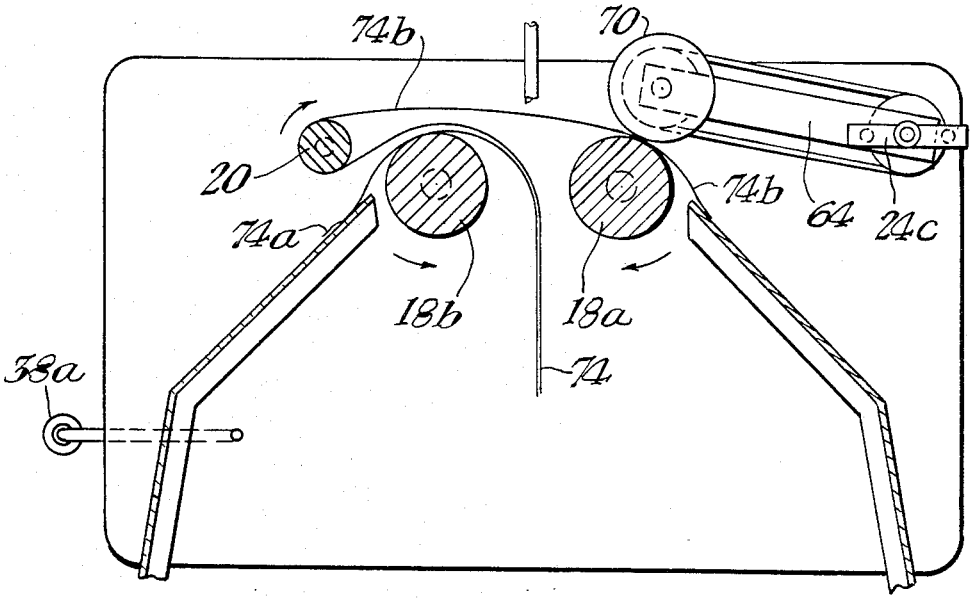
FIG. 12 shows an enlarged side elevational schematic view of the paper path used in the embodiment shown in FIG. 10.

FIGS. 10, 11, and 12 show a first alternate embodiment of the present invention which includes an attachment to make the device suitable for separating carbonless, multiple ply business forms. The attachment includes a rigid drive shaft 52 having an end bracket 66 with two prongs that mount within and replace the carbon reel shown previously. The attachment drive shaft 52 includes a pulley 58 rigidly fixed near the central portion. A pair of guide bars 62 and 64 are moveably connected to drive shaft 52 such that the drive shaft 52 can rotate freely while being connected to guide bars 62 and 64. The other end of the guide bars 62 and 64 are connected to a wheel mounting shaft 56 having a pair of wheels 70 and 72 attached at each end. The central portion of shaft 56 includes a pulley 60 that is connected by a belt 68 to pulley 58. The wheels 70 and 72 rest firmly on roller 18*a*, due to the weight of the wheels and the wheel shaft.

To operate this embodiment for separating carbonless multi-ply business forms (FIG. 12), the form to be separated 74 is directed upwardly between rollers 18*a* and 18*b*. The unseparated form is then disposed over the top of the roller 18*b* and separated such that the upper ply 74*b* is wrapped around the carbon guide bar (described above) 20 and directed back toward roller 18*a* being positioned between the wheels 70 and 72 and the roller 18*a*. The other ply 74*a* is directed downwardly from roller 18*b*. Rotation of the hand crank 38*a* causes member 24*c* to rotate and through the action of belt 68, causes wheels 70 and 72 to rotate in the direction of the arrow. This pulls on ply 74*b*, forcing the multiple ply 74 upward between the rollers 18*a* and 18*b* and the ply 74*b* back through rollers 18*a* and the wheels. The other ply 74*a* is forced by gravity, thus in effect the wheels 70 and 72 are pulling on ply 74 effect separation of the two plies into separate single ply stacks.

And yet another alternate embodiment of the attachment for use with carbonless paper, FIGS. 13, 14, 15, and 16 show the drive shaft 78 having a pulley 100 and an attaching member 114 used as the driving member and attached replacing the carbon reel. A first pair of wheels 92 and 94 are connected to shaft 80 which has two pulleys 102 and 104 affixed thereto. Guide bars 84 and 86 attach shaft 80 to shaft 78. A second set of wheels 96 and 98 are attached to shaft 82 which includes a pulley 106 affixed thereto. A belt 108 attached pulley 100 to pulley 102, by an inverted belt 110 attaching pulley 104 to pulley 106. Guide bars 88 and 90 attach shaft 80 to shaft 82. In this embodiment, the wheels 92 and 94 are positioned such that they rest on roller 18*a* while wheels 96 and 98 rest on rollers 18*b*. Belt 110 is inverted or formed in a figure eight. Rotation of shaft 78 (FIG. 16) causes shaft 80 to rotate in one direction and shaft 82 to rotate in the opposite direction.

As shown in FIG. 15, a carbonless, multiple ply form 112 is received vertically upward between rollers 18*a* and 18*b*. The form is separated into two plies 112*a* and 112*b* between the respective roller and the pairs of wheels disposed above each roller. The force of the rotating pairs of wheels provides a force on each ply 112*a* and 112*b* in the direction indicated, effecting separation of the ply.

Thus, using either alternate embodiment showing the attachment to the device, carbonless paper may be readily separated into separate stacked plys.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A desk top deleaver for decollating an assembly of continuous forms including a plurality of continuous sheets into separate stacks comprising:

a housing including four sheet means for guiding the continuous forms, said four sheet means including two sheet means, a third sheet means and a fourth sheet means, said two sheet means for decollating an assembly of continuous forms having at least a first sheet, a second sheet and a third sheet, said two sheet means comprising a first sheet means for supporting and changing the direction of travel of a first sheet toward one of the separate stacks and a second sheet means for supporting and changing the direction of travel of a second sheet toward another one of the separate stacks, said two sheet means connected to said housing, each of said first sheet means and said second sheet means having a center line positioned generally parallel to a transverse line across the first sheet and the second sheet, said two sheet means positioned in spaced apart relationship forming a working space between said two sheet means through which the continuous forms move in a direction from an entrance side of said working space between said two sheet means toward an exit side of said working space between said two sheet means, said working space lying in a generally horizontal plane, a take-up means, for taking up the third sheet, said third sheet means for changing and redirecting the third sheet toward said take-up means, said third sheet means having a center line generally parallel to said center lines of said two sheet means and connected to said housing and positioned adjacent said first sheet means and positioned near said working space with said working space generally between said third sheet means and said second sheet means, said take-up means connected to said housing and positioned adjacent said second sheet means and positioned near said working space with said working space generally between said take-up means and said first sheet means, said take-up means constructed and arranged to pull the third sheet through said working space with the aid of said fourth sheet means, said third sheet means and said take-up means connected to said housing and connected and arranged to position the third sheet with the aid of said fourth sheet means to frictionally engage the second sheet of the continuous forms after decollating to aid in properly separating the assembly of continuous forms moving through said working space, said fourth sheet means having a center line generally parallel to said center lines of said two sheet means and connected to said housing, and said fourth sheet means positioned and arranged to engage the third sheet after the third sheet has been redirected by said third sheet means in a location between said third sheet means and said second sheet means, said fourth sheet means engaging said third sheet on a surface thereof opposite said working space to force said third sheet to track along a path in said working space between said two sheet means said working space, said third sheet positioned by said fourth sheet means to aid in proper decollating of the assembly of continuous forms by contacting and moving the second sheet over said second sheet means and by increasing the contact area between the second sheet and the third sheet when the second sheet attempts to move over said first sheet means thereby aiding in proper decollating.

2. A desk top deleaver as set forth in claim 1, wherein:

said first sheet means and said second sheet means and said take-up means being so constructed and arranged that the third sheet being pulled by said take-up means (a) frictionally engages the first sheet on said first sheet means, before the first sheet and the third sheet are separated so that the third sheet being pulled by said take-up means may aid the movement of the first sheet in one direction to deposit the first sheet onto said one of the separate stacks and (b) frictionally engages the second sheet on said second sheet means, after the third sheet and the first sheet are separated, so that the third sheet being pulled by said take-up means may aid the movement of the second sheet in the other direction to deposit the second sheet onto the other one of the separate stacks.

3. A desk top deleaver as recited in claim 1 wherein: said two sheet means are nondriving sheet means and said desk top deleaver includes, a movable drive wheel connectable to and driven by said take-up means, said drive wheel connected to said take-up means and positioned against said second sheet means permitting use of said deleaver with continuous carbonless form paper having only a first sheet and a second sheet with the second sheet connected to said first sheet as it moves over said first sheet means and said second sheet is positioned to move around said third sheet means and over said second sheet means between said drive wheel and said second sheet means.

4. A desk top deleaver as recited in claim 1 further including;

support means mounted on said housing for supporting the first sheet and the second sheet during movement to the separate stacks.

5. A desk top deleaver as recited in claim 1 wherein: said first sheet means, said second sheet means, and said third sheet means are idler rollers and said take-up means is a carbon wind-up reel.

* * * * *